US005267868A

United States Patent [19]

Wolff, Jr.

[11] Patent Number: 5,267,868

[45] Date of Patent: Dec. 7, 1993

[54] SHIELDED ELECTRICAL CONNECTOR ASSEMBLIES

[75] Inventor: Richard H. Wolff, Jr., Taipei, Taiwan

[73] Assignee: Molex Incorporated, Lisle, Ill.

[21] Appl. No.: 955,179

[22] Filed: Oct. 1, 1992

[51] Int. Cl.[5] ..... H01R 13/648

[52] U.S. Cl. ..... 439/95; 439/607; 439/610

[58] Field of Search ..... 439/95, 96, 97, 108, 439/607, 608, 609, 610

[56] References Cited

U.S. PATENT DOCUMENTS 4,633,048 12/1986 Komatsu ..... 200/51.1

4,753,605 6/1988 DeYoung ..... 439/347

4,925,405 5/1990 Wei ..... 439/608

5,073,123 12/1991 Birch et al. ..... 439/188

*Primary Examiner*—Gary F. Paumen

*Attorney, Agent, or Firm*—Stephen Z. Weiss

[57] ABSTRACT

A shielded electrical connector assembly includes a dielectric body, a terminal mounted on the body and a conductive shield about the body. The body is overmolded about a plate-like ground plane which has wings projecting outwardly of the body. The shield has slots into which the wings of the ground plane are inserted to thereby facilitate mounting the body in the shield and conductively coupling the ground plane with the shield.

8 Claims, 4 Drawing Sheets

SHIELDED ELECTRICAL CONNECTOR ASSEMBLIES

FIELD OF THE INVENTION

This invention generally relates to the art of electrical connectors and, particularly, to a shielded electrical connector assembly or system which includes a ground plane.

BACKGROUND OF THE INVENTION

Shielded electrical connectors are used in many applications to protect against radio frequency interference (RFI) and/or electromagnetic interference (EMI) in regard to the signals, data or the like which is transmitted through appropriate lines or cables to which the shielded connectors are terminated. There are a wide variety of shielded electrical connector designs, including those which include a metal shield, such as of stamped and formed sheet metal material, which surrounds various internal components, such as the terminals, of the connector assembly.

One of the problems constantly plaguing shielded electrical connectors is that they are fabricated of many different pieces and are not easily assembled. All of the necessary or conventional components of a particular electrical connector design are required, and the addition of some sort of shielding means simply adds to the problem.

The undue complexity of shielded electrical connector assemblies further is compounded when it is desirable to incorporate a ground plane to further enhance RFI and/or EMI protection. The ground plane can be of various configurations, but the ground plane often is coupled to the shield of the connector.

This invention is directed to a shielded electrical connector design which is easy to manufacture, with a minimum number of parts and which is surprisingly simple to assemble, including coupling of a ground plane of the connector directly to a shield of the connector.

SUMMARY OF THE INVENTION

An object, therefore, of the invention is to provide a new and improved shielded electrical connector assembly or system of the character described.

In the exemplary embodiment of the invention, the shielded electrical connector assembly includes a dielectric body, a terminal mounted on the body and a conductive shield about the body. The invention contemplates that the shield include slot means, and the body mounts a conductive ground plane means having wing means projecting therefrom for interengagement in the slot means of the shield, thereby to perform the dual function of mounting the body in the shield and also conductively coupling the ground plane with the shield.

As disclosed herein, the dielectric body, the terminal and the ground plane means all are incorporated in a single module, with the body at least partially overmolded about portions of the terminal and the ground plane means. This module simply is assembled within the conductive shield.

To further simplify assembly, the ground plane means is provided in the form of a plate-like member having edges exposed along sides of the dielectric body, the edges defining the wing means interengageable in the slot means of the shield. The shield is fabricated of stamped and formed sheet metal material and has slots in corresponding sides thereof for receiving the edges of the plate-like ground plane. In assembly, the edges of the ground plane simply slide into the slots of the shield to mount the module in the shield and simultaneously conductively couple the ground plane with the shield. No other extraneous mounting or coupling components or means whatsoever are required to assemble the shielded electrical connector assembly of the invention.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
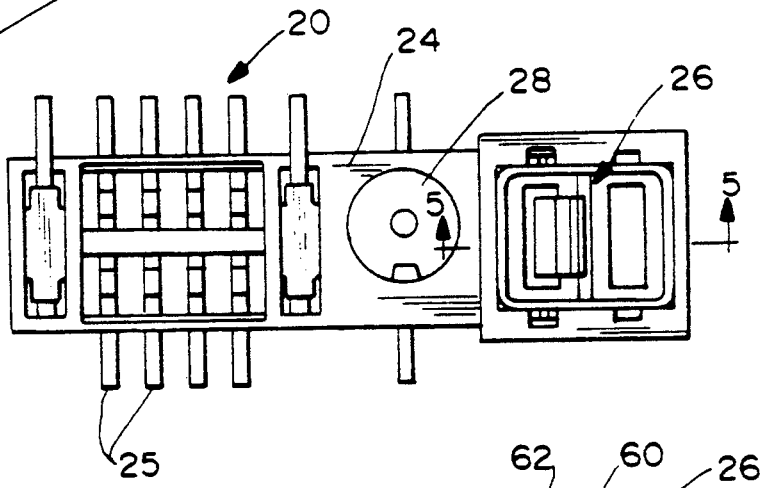
FIG. 1 is a plan view of a composite female connector apparatus incorporating a shielded electrical connector assembly according to the invention.
Figure 2:
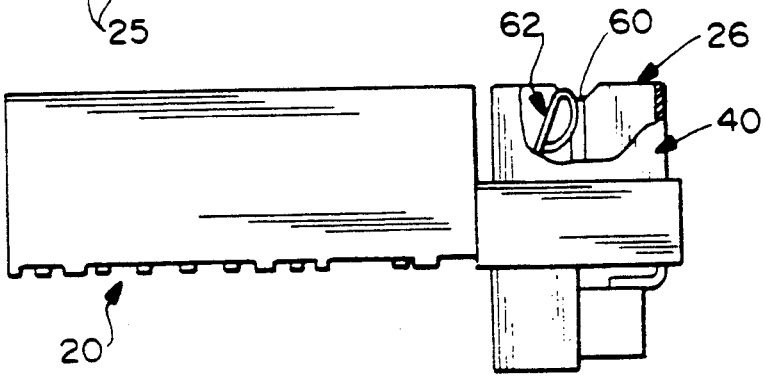
FIG. 2 is a side elevational view of the connector apparatus of FIG. 1.
Figure 3:
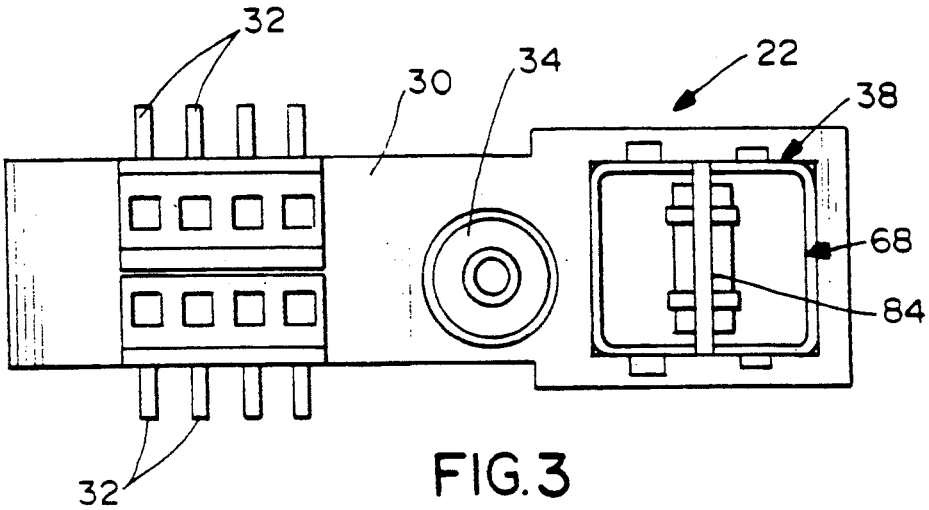
FIG. 3 is a plan view of a composite male connector apparatus incorporating a shielded electrical connector assembly according to the invention.
Figure 4:
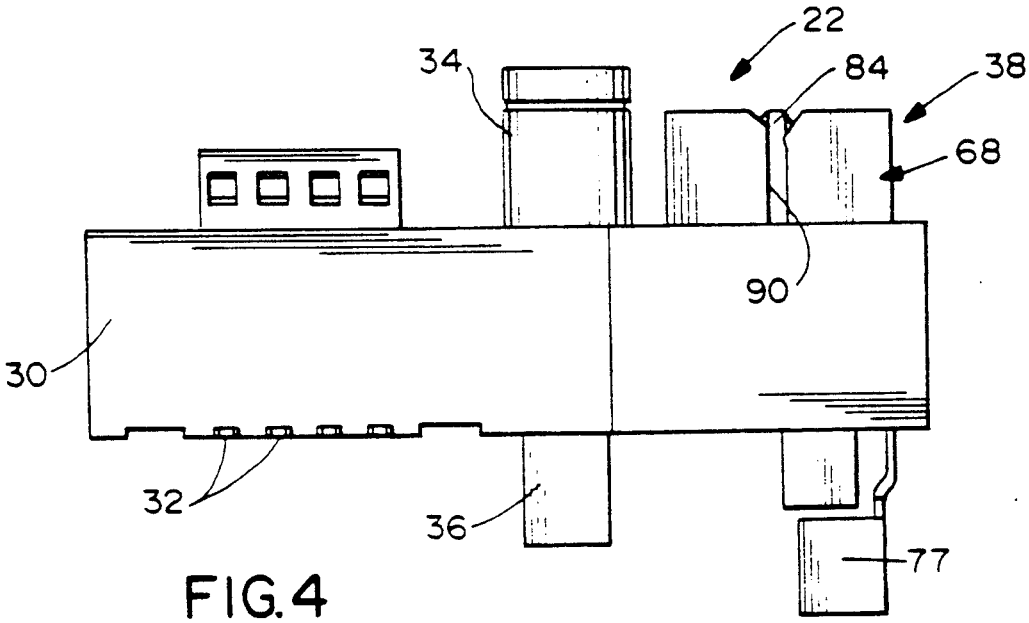
FIG. 4 is a side elevational view of the connector apparatus of FIG. 3.
Figure 5:
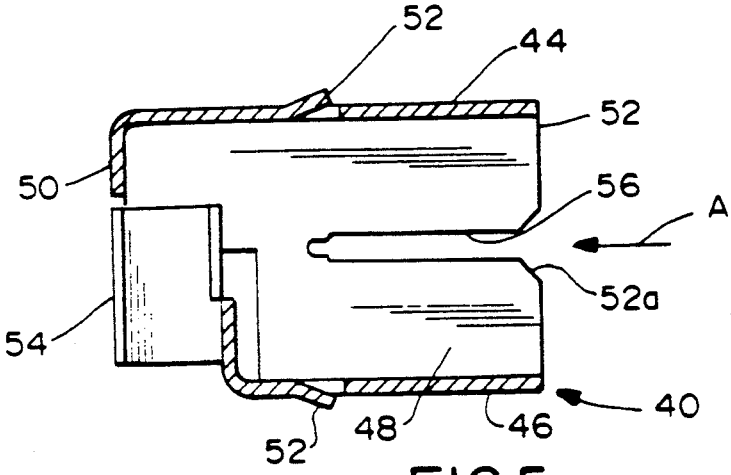
FIG. 5 is a vertical section through the shield means, isolated from the composite connector apparatus, as would be taken in the direction of line 5—5 of FIG. 1.

Referring to the drawings in greater detail, FIGS. 1 and 2 show a composite female connector apparatus, generally designated 20, for mating with a composite male connector apparatus, generally designated 22 in FIGS. 3 and 4. The depictions of FIGS. 1–4 are provided simply to show applications of the shielded electrical connector assemblies or system of the invention and, therefore, the depictions are not to be considered limiting. Composite female connector apparatus 20 (FIGS. 1 and 2) may be used in a handset of a portable or mobile telephone device, for example. Composite male connector apparatus 22 (FIGS. 3 and 4) might be used in a cradle of the base unit of the mobile telephone. Suffice it to say, composite female connector apparatus 10 includes an elongated dielectric housing 24 for mounting a plurality of terminals 25 of a data connector portion defined at the left-hand end of the housing. A shielded signal electrical connector assembly, generally designated 26, is mounted in the right-hand end of housing 24 and incorporates the concepts of the invention. A DC jack 28 is disposed intermediate the ends of the housing. Jack 28 and the data connector portion at the left-hand end of housing 24 do not form part of the invention but are illustrated simply for exemplary purposes to show an application of shielded electrical assembly 26 of the invention.

Likewise, composite male connector apparatus 22 (FIGS. 3 and 4) includes an elongated dielectric housing 30, molded of plastic material or the like and defining a data connector portion at the left-hand end thereof, including terminals 32 for mating with data terminals 25 of composite female connector apparatus 20 (FIGS. 1 and 2). A DC plug 34 is mounted intermediate the ends of housing 30 for mating with DC jack 28 of connector housing 24 of composite female connector apparatus 20, the plug including a solder cup 36 (FIG. 4) providing a cable termination end of the plug. In composite male connector apparatus 22, the invention is incorporated in a shielded signal electrical connector assembly, generally designated 38, which is mounted in the right-hand end of housing 30 for mating with shielded electrical connector assembly 26 of composite female connector apparatus 20 in FIG. 1.

Figure 7:
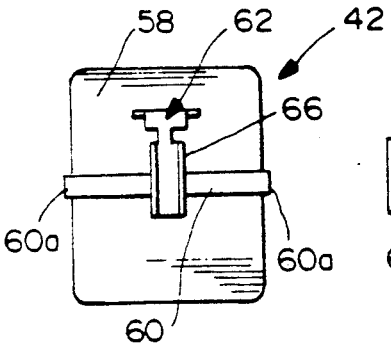
FIG. 7 is an end elevational view looking toward the left-hand end of the module of FIG. 6.
Figure 6:
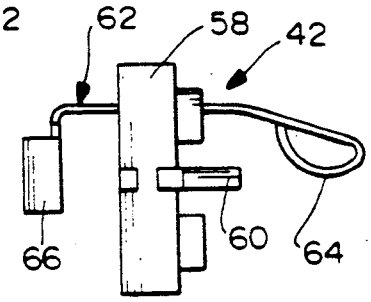
FIG. 6 is a side elevational view of the terminal/-ground plane module of the connector assembly incorporated in the connector apparatus of FIG. 1, and as would be mounted within the shield of FIG. 5.
Figure 8:
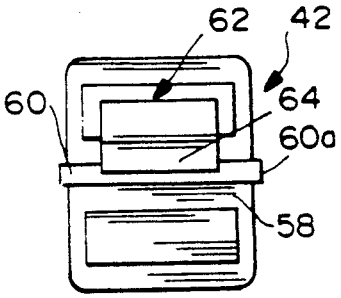
FIG. 8, is an end elevational view looking toward the right-hand end of the module of FIG. 6.

More particularly, referring to FIGS. 5–8 in conjunction with FIGS. 1 and 2, shielded electrical connector assembly 26 (FIG. 1) includes a shield, generally designated 40 (FIG. 5) into which is assembled a terminal/ground plane module, generally designated 42 (FIGS. 6–8). Shield 40 is generally box-shaped defined by a top wall 44, a bottom wall 46, a pair of side walls 48, a partial end wall 50 and an open end 52 into which module 42 is assembled. The shield is unitarily fabricated of stamped and formed sheet metal material, and top and bottom walls 44 and 46, respectively, have retaining tabs 52 stamped therefrom and bent outwardly for gripping into the plastic material of housing 24 (FIG. 1) when mounted therein. A socket 54 is formed at the juncture of bottom wall 46 and partial end wall 50 for receiving a coaxial cable.

Both side walls 48 of shield 40 include slots 56 to facilitate mounting module 42 within the shield and conductively coupling a ground plane of the module to the shield, as described above. It should be noted that the slots have open chamfered ends **56*a*, the slots being oriented to define an insertion direction of module 42**, as indicated by arrow "A".

The terminal/ground plane module 42 (FIGS. 6–8) includes a dielectric body 58 which is overmolded about a plate-like ground plane 60. The body also is overmolded about an intermediate portion of a terminal, generally designated 62. The terminal has a contact end 64 and a cable terminating end 66. The cable terminating end forms a socket alignable within socket 54 of shield 40 for termination to the conductor of the coaxial cable which is retained within the shield socket.

As best seen in FIGS. 7 and 8, ground plane 60 is a plate-like member and includes a pair of opposite edges **60*a* which define wings projecting outwardly from dielectric body 58. In assembly of shielded electrical connector assembly 26, the entire terminal/ground plane module 42 (FIGS. 6–8) is inserted into open end 52 of shield 40 (FIG. 5) in the direction of arrow "A". During assembly, edges or wings 60*a* of the plate-like ground plane 60 ride or slide into slots 56 in the opposite side walls 48 of the shield. The slots should be slightly narrower than the thickness of the ground plane wings to establish a sufficiently tight fit to enhance conductivity between the ground plane and the shield. Therefore, it can be seen that the ground plane (i.e. its edges or wings) perform the dual function of (1) mounting the entire module 42** within the shield, and (2) establish conductive continuity between the ground plane and the shield.

Referring to FIGS. 9–13 in conjunction with FIGS. 3 and 4, the concepts of the invention described above in relation to shielded electrical connector assembly 26 (FIGS. 1 and 2) is similar to the following description of shielded electrical connector assembly 38 (FIGS. 3 and 4). In other words, the very simple construction and simple assembly of shielded electrical connector assembly 38 is the same as that of shielded electrical connector 26.

Figure 9:
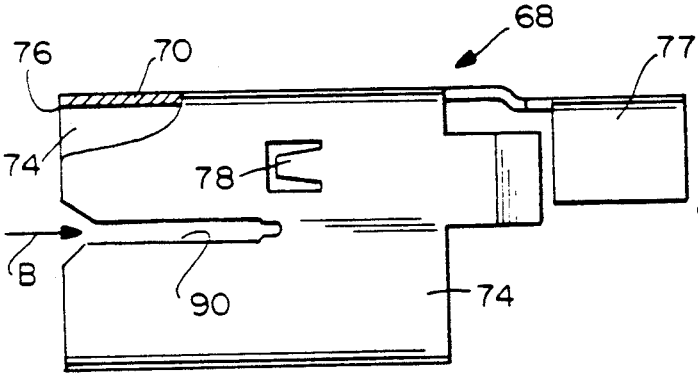
FIG. 9 is a side elevational view of the shield of the connector assembly incorporated in the composite connector apparatus of FIGS. 3 and 4.
Figure 11:
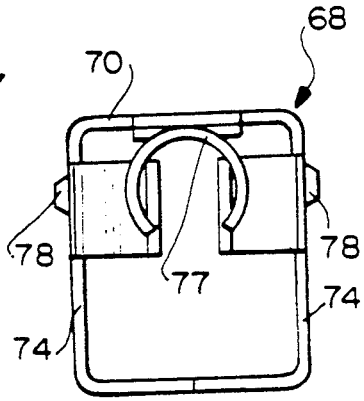
FIG. 11 is an end elevational view looking toward the right-hand end of the shield in FIG. 7.
Figure 10:
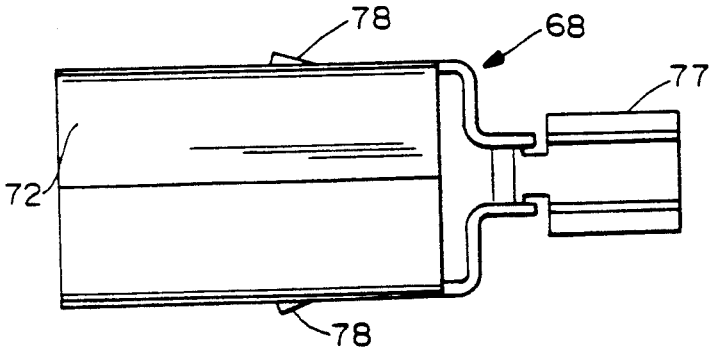
FIG. 10 is a bottom plan view of the shield of FIG. 7.

More particularly, referring first to FIGS. 9–11, shielded electrical connector assembly 38 includes a box-like shield, generally designated 68, which includes a top wall 70, a bifurcated bottom wall 72, a pair of opposite side walls 74 and an open end 76 (FIG. 9). A socket 77 projects rearwardly as a continuation of top wall 70 for receiving a coaxial cable. Like shield 40, shield 60 is a unitary structure stamped and formed of sheet metal material, and side walls 74 include stamped and outwardly formed retaining tabs 78 for biting into the plastic material of housing 30 of composite male connector apparatus 22 (FIGS. 3 and 4).

Figure 13:
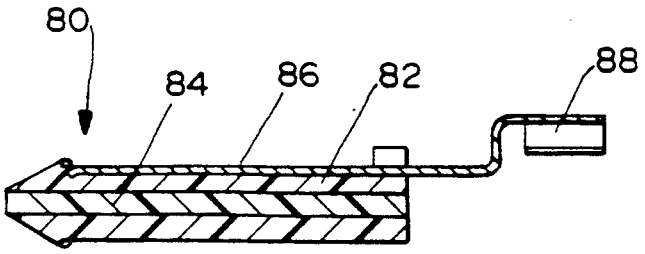
FIG. 13 is a vertical section taken generally along line 13—13 of FIG. 12.
Figure 12:
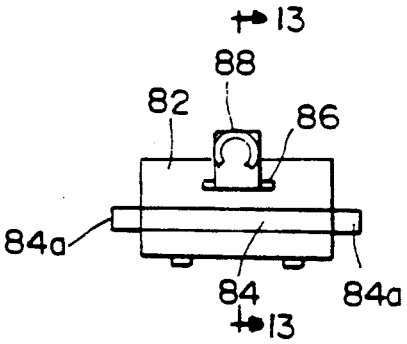
FIG. 12 is an end elevational view of the terminal/-ground plane module insertable into the shield of FIGS. 9-11.

Referring to FIGS. 12 and 13, shielded electrical connector assembly 38 includes a terminal/ground plane module, generally designated 80. The module includes a dielectric body 82 overmolded about a plate-like ground plane 84. The body also is overmolded about a generally flat terminal 86 having a socket 88 which, when assembled within shield 68, is aligned with socket 77 of the shield, for termination to the conductor of the coaxial cable retained within the socket.

As best seen in FIG. 12, plate-like ground plane 84, like ground plane 60, includes a pair of edges or wings **84*a* projecting outwardly from dielectric body 82. The module is inserted into shield 68 in the direction of arrow "B" (FIG. 9). In assembly, edges or wings 84 of the ground plane ride or slide into slots 90 formed in side walls 74 of the shield. Therefore, again, the cooperation between the ground plane (i.e. its edges or wings) and shield 68 is the same as described above in relation to module 42 and shield 40 of shielded electrical connector assembly 26. In other words, a dual function is provided in that the wings of the ground plane, assembled within slots 90, are effective to (1) mount module 80 within shield 68, and (2) conductively couple the ground plane to the shield The assembled connector assembly then simply is bodily assembled within housing 30 of composite male connector apparatus 22 as seen in FIGS. 3 and 4**.

From the foregoing, the simple manufacture and ease of assembly of shielded electrical connector assemblies 26 and 38 are readily apparent. The dielectric bodies 58 and 82 of the connector assemblies are easily and simply overmolded about the respective terminals 62 and 86 as well as the respective ground planes 60 and 84. These modules then are easily mounted within their respective shields 40 and 68 simply by sliding the wings of the ground planes into the slots in the side walls of the shields. The design keeps the size of the connector assemblies small while maintaining the characteristic impedance across the connectors at or near 5 ohms.

Although these connector assemblies, at that point, are completed shielded electrical connector assemblies in and of themselves, these connector assemblies also can be readily used as subassemblies for composite connector apparatus such as composite female and male connector apparatus 20 and 22, respectively. It can be seen that very few parts are required to provide an effective shielded connector assembly which includes a ground plane, and without requiring any extraneous mounting or assembly components other than the dielectric bodies, the terminals, the ground planes and the shields themselves.

Figure 14:
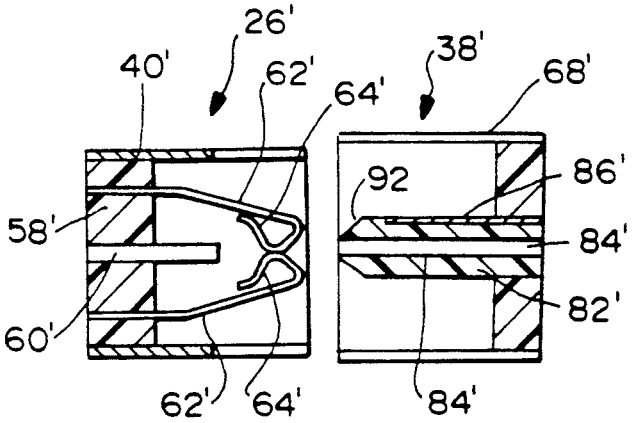
FIG. 14 is a fragmented sectional view through a pair of mating shielded electrical connector assemblies in unmated condition and incorporating an alternate embodiment of a switching system.
Figure 15:
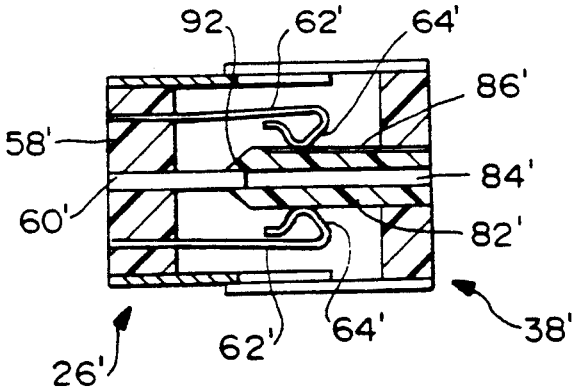
FIG. 15 is a section similar to that of FIG. 14, with the connector assemblies in mated condition.

Lastly, FIGS. 14 and 15 show an alternate embodiment of the invention wherein fragmented portions of a pair of shielded electrical connector assemblies 26' and 38' are illustrated in a switching connector system. Connector assembly 26' is similar to connector assembly 26 in that it includes a shield 40' into which is assembled a module including a dielectric body 58' overmolded about a plate-like ground plane 60'. However, it can be seen that a pair of terminals 62' each include contact ends 64' which are in electrical engagement. Similarly, connector assembly 38 includes a shield 68' into which is assembled a module including a dielectric body 82', and a plate-like ground plane 84'. The body is overmolded about the ground plane as well as about a flat terminal 86'. FIG. 14 shows connector assemblies 26' and 38' in unmated condition. The female connector apparatus 26' ensures that the handset is connected to the handset antenna (not shown). Like terminal 86 in FIG. 13, terminal 86 is spaced from a distal end 92 of dielectric body 82'.

Therefore, when connector assemblies 26' and 38' are mated as shown in FIG. 15, during mating the distal end or nose 92 of dielectric body 82' separates contact ends 64' of terminals 62' to provide a "break-before-make" system wherein the electrical connection between terminals 62' is broken, or a switch therebetween is opened, before terminal 86' makes electrical connection with the upper terminal 62'. With the switch open the mobile phone handset is automatically disconnected from the handset antenna and connected with an outside mobile antenna (not shown) .

FIG. 15 also shows that when the connector assemblies are mated, ground planes 60' and 84' abut one another within nose 92 of dielectric body 82'. This establishes a conductive ground plane continuously through the mated connector assemblies. This also is true when connector assembly 26 (FIGS. 1 and 2) is mated with connector assembly 38 (FIGS. 3 and 4), although ground plane 84 (FIG. 13) is not recessed within the nose of dielectric body 82. Ground planes 60 and 84 simply abut when connector assemblies 26 and 38 are mated in response to mating of composite female connector apparatus 20 with composite male connector apparatus 22.

Figure 16:
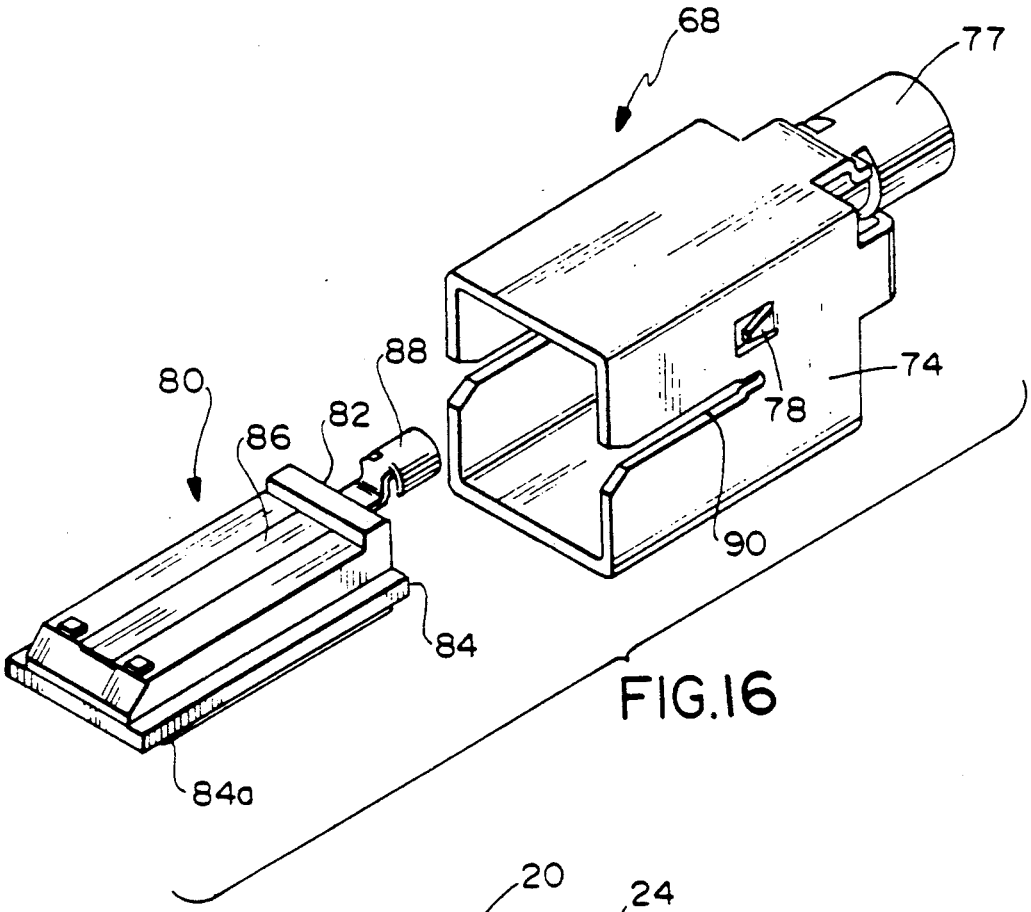
FIG. 16 is an exploded isometric view of the male connector apparatus incorporating the shielded electric connector assembly according to the invention.

FIG. 16 is an exploded isometric view of the male connector apparatus incorporating the shielded electric connector assembly according to the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a shielded electrical connector assembly which includes a dielectric body, a terminal mounted on the body, and a conductive shield about the body fabricated of stamped and formed sheet metal material, wherein the improvement comprises said shield including slot means in opposing sidewalls of said shield, and said body mounts a conductive ground plane within the shield comprising a plate-like member with edges defining wing means projecting outwardly from opposite sides of the dielectric body toward the opposing sidewalls for interengagement in the slot means of the shield to thereby facilitate mounting the body in the shield and conductively coupling the ground plane with the shield.

2. In a shielded electrical connector assembly as set forth in claim 1, wherein said body comprises a plastic component which is at least partially overmolded about the ground plane with the edge thereof exposed at a side of the overmolded body.

3. In a shielded electrical connector assembly as set forth in claim 2, wherein the slot means of said shield comprise a pair of slots on opposite sides of the shield, and said plate-like member has opposite edges exposed exteriorly of the overmolded body and respectively interengageable in the slots of the shield.

4. In a shielded electrical connector assembly as set forth in claim 3, wherein said shield has an open end into which the body is insertable in assembly, and the slots are oriented in the insertion direction of the body so that the edges of the plate-like member can slide into the slots when the body is inserted into the shield.

5. In a shielded electrical connector assembly as set forth in claim 1, wherein said body comprises a plastic component which is at least partially overmolded about a portion of the ground plane.

6. In a shielded electrical connector assembly as set forth in claim 5, wherein said body is at least partially overmolded about a portion of the terminal.

7. In a shielded electrical connector assembly as set forth in claim 1, wherein said shield has an open end into which the body is insertable in assembly, and said slot means is oriented in the insertion direction of the body so that said wing means can slide into the slot means when the body is inserted into the shield.

8. In a shielded electrical connector assembly as set forth in claim 7, wherein said slot means of the shield comprises a pair of slots on opposite sides of the shield, and said ground plane comprises a plate-like member having opposite edges exposed exteriorly of the body and respectively slidable into the slots of the shield.

* * * * *